US006712215B2

(12) United States Patent
Scheybeler

(10) Patent No.: US 6,712,215 B2
(45) Date of Patent: Mar. 30, 2004

(54) METHOD AND APPARATUS FOR RECOVERY OF LOST DILUENT IN OIL SANDS EXTRACTION TAILINGS

(76) Inventor: Adolf Frederik Scheybeler, #35 Windmere Drive, Alberta (CA), T7X 1P9

( * ) Notice: Subject to any disclaimer, the term of this patent is extended or adjusted under 35 U.S.C. 154(b) by 358 days.

(21) Appl. No.: 09/905,818

(22) Filed: Jul. 16, 2001

(65) Prior Publication Data

US 2002/0043579 A1 Apr. 18, 2002

Related U.S. Application Data

(60) Provisional application No. 60/221,373, filed on Jul. 28, 2000.

(51) Int. Cl.[7] ..... C01G 1/04

(52) U.S. Cl. ..... 209/135; 34/372; 208/390

(58) Field of Search ..... 209/133, 134, 209/135, 136, 137, 146, 154, 906; 34/372, 373, 374, 356; 241/18, 19, 20; 208/390, 391, 415, 424, 425

(56) References Cited

U.S. PATENT DOCUMENTS 3,875,046 A * 4/1975 Rosenbloom ..... 208/391
3,967,777 A * 7/1976 Canevari ..... 494/35
4,160,718 A * 7/1979 Rendall ..... 208/390
4,424,112 A * 1/1984 Rendall ..... 208/390
4,722,782 A * 2/1988 Graham et al. ..... 208/390
4,783,268 A * 11/1988 Leung ..... 210/703
4,818,373 A * 4/1989 Bartholic et al. ..... 208/252
5,143,598 A * 9/1992 Graham et al. ..... 28/390
6,358,404 B1 * 3/2002 Brown et al. ..... 208/390
2003/0083206 A1 * 5/2003 Masikewich et al. ..... 507/265

* cited by examiner

*Primary Examiner*—Donald P. Walsh
*Assistant Examiner*—Joseph C Rodriguez
(74) *Attorney, Agent, or Firm*—Stanley H. Zeyher

(57) ABSTRACT

A method of solvent recovery from oil sand extraction plant tailings, using 180 degree opposing steam-assisted accelerating nozzles, impacting on each other's high velocity jets, thus creating an impact area at the point of collision, creating an exceedingly large number of small droplets having a very large surface area exposed to the depressurized environment inside the vessel in which the nozzles are mounted. The diluent thus escaping from the tiny droplets is collected from the vessel space and recovered by condensation in a surface condensor and returned to the process.

1 Claim, 3 Drawing Sheets

METHOD AND APPARATUS FOR RECOVERY OF LOST DILUENT IN OIL SANDS EXTRACTION TAILINGS

FIELD OF THE INVENTION

This invention is based on Provisional Application entitled Method and Apparatus for Recovery of Lost Diluent in Oil Sands Extraction Tailings, filed Jul. 28, 2000, application No. 60/221,373, and claims the priority filing date of that application.

BACKGROUND OF THE INVENTION

A diluent is used to reduce the viscosity of the recovered bitumen from oil sands. The viscosity must be reduced to make it possible to remove the residual impurities like water and fine minerals from the bitumen.

The diluent that is used is mixed with the recovered bitumen, at a certain ratio with the bitumen, to arrive at a workable viscosity of the diluted bitumen.

When the impurities are removed, as for example by centrifugation, a certain percentage of the original diluent is lost along with the water and fine solids.

The present methods of stripping the diluents from the tailing stream is to use vacuum distillation with overhead vapour recovery. These methods are only partially successful in recovering the diluent. This results in substantial economic loss.

SUMMARY OF THE INVENTION

The present invention provides a method and apparatus for diluent recovery from extraction tailings that is more effective than existing procedures.

According to one aspect of the invention streams of extraction tailings Are directed through a nozzle at an impaction target. Next, saturated steam is injected into the stream of extraction tailings to produce a confluent stream of steam and extraction tailings. Rapid expansion of the steam causes acceleration of the composite stream resulting in a violent collision with the impaction target. The expanding steam dramatically increases the impact velocity. By utilizing this technique impact velocities approaching 7,000 feet per minute can be achieved. It is preferred to use a plurality of nozzles positioned in a common horizontal plane with a stream of one of the nozzles serving as the impaction target for the other of the nozzles. A preferred configuration is to position two nozzles in 180 degree opposed orientation.

Utilizing the above principles of operation there is provided an apparatus for diluent recovery which is comprised of a containment vessel having a top, a bottom, and peripheral side walls. A plurality of inlet nozzles are secured in a common horizontal plane to the peripheral side walls. Each nozzle has a first inlet for receiving a first fluid, a second inlet for receiving a second fluid and a single outlet for discharging a mixed stream of the first and second fluids. The mixed discharge stream of one of the nozzles is focused at the mixed discharge stream of the other of the nozzles, such that the mixed discharge streams impact each other. Means is provided positioned adjacent the top of the containment vessel for drawing off the vapors resulting from the impact. An outlet is positioned adjacent the bottom of the containment vessel for removing extraction tailings which have been stripped of diluent.

Although there are a variety of configurations that can be used in terms of the number of nozzles, it is preferred to use two nozzles oriented in a common plane disposed in confronting relation 180 degrees apart.

While there are a variety of nozzles that are capable of handling a mixed stream of steam and extraction tailings, it is preferred that the nozzle enhance the accelerating effect of the rapidly expanding steam. Even more beneficial results may be obtained when each nozzle includes a body having a passage leading to the outlet and the first inlet has an extension portion disposed in the passage. A steam chamber communicates with the first inlet and circumscribes the second inlet. The steam chamber has a short spiral that surrounds the second inlet, imparting to the steam flow a spiraling motion at the outlet of the nozzle. The rotating and accelerating steam flow will tend further to increase the intensity of the impact when the opposing jets meet.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
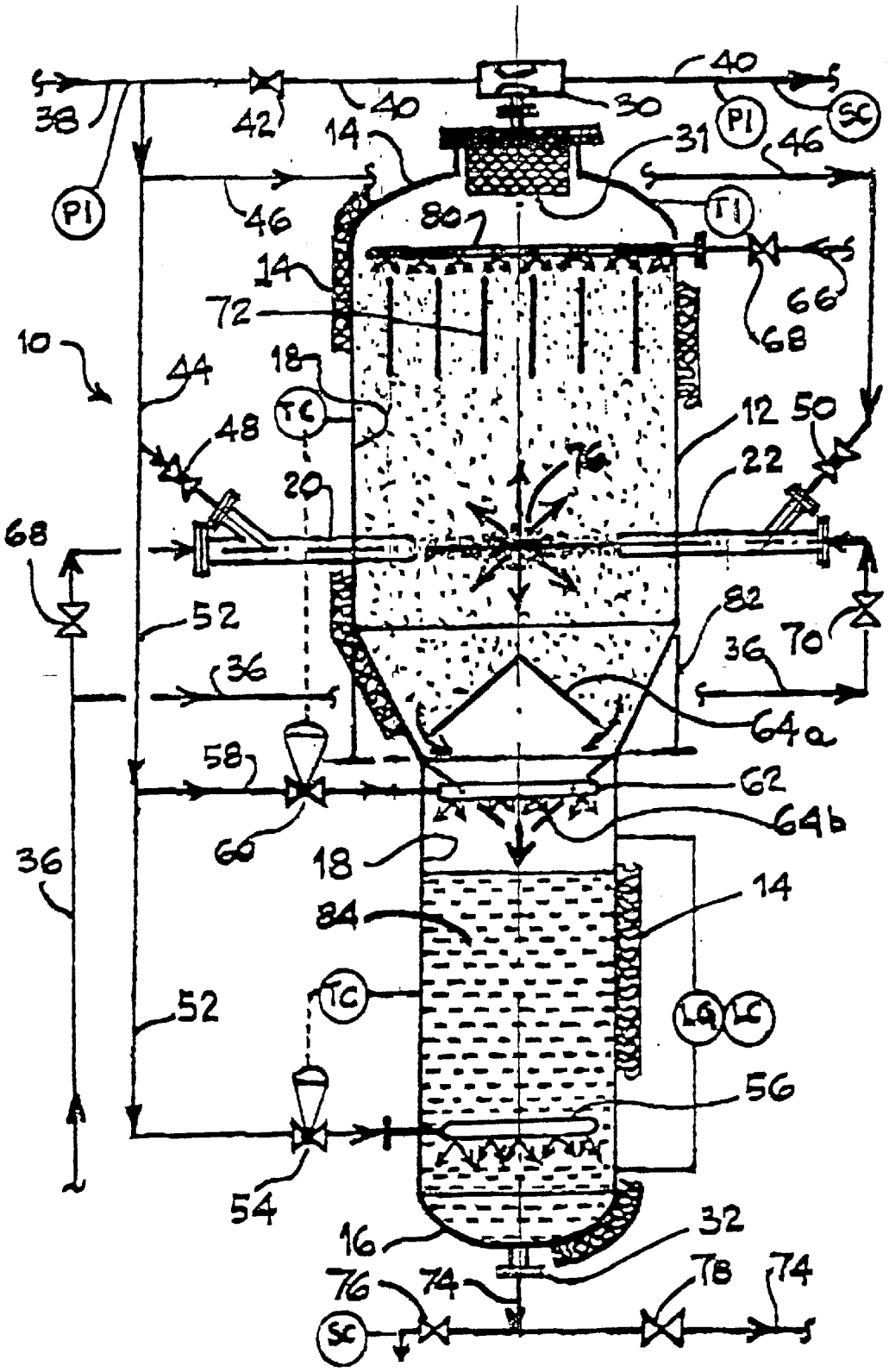
FIG. 1 is a front sectional elevation of apparatus for recovering diluent from extraction tailings constructed in accordance with the teachings of this invention.
Figure 3:
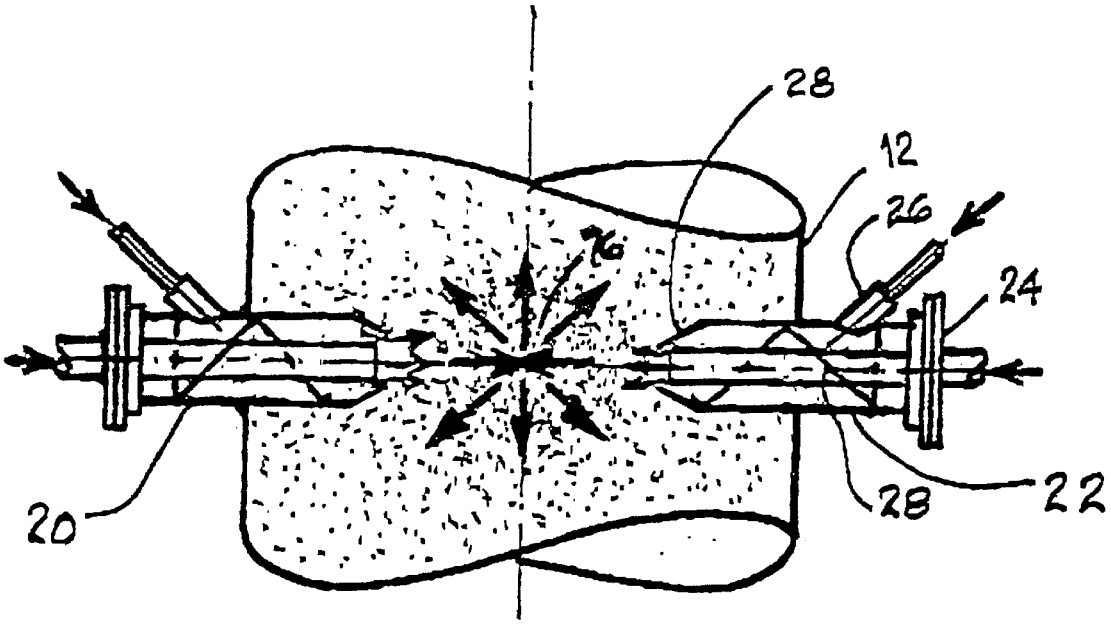
FIG. 3 is a side elevation view of the nozzles shown in FIG. 2, to illustrate the formation of the fine droplets produced as a result of the high velocity impact when the streams meet at mid-vessel.
Figure 5:
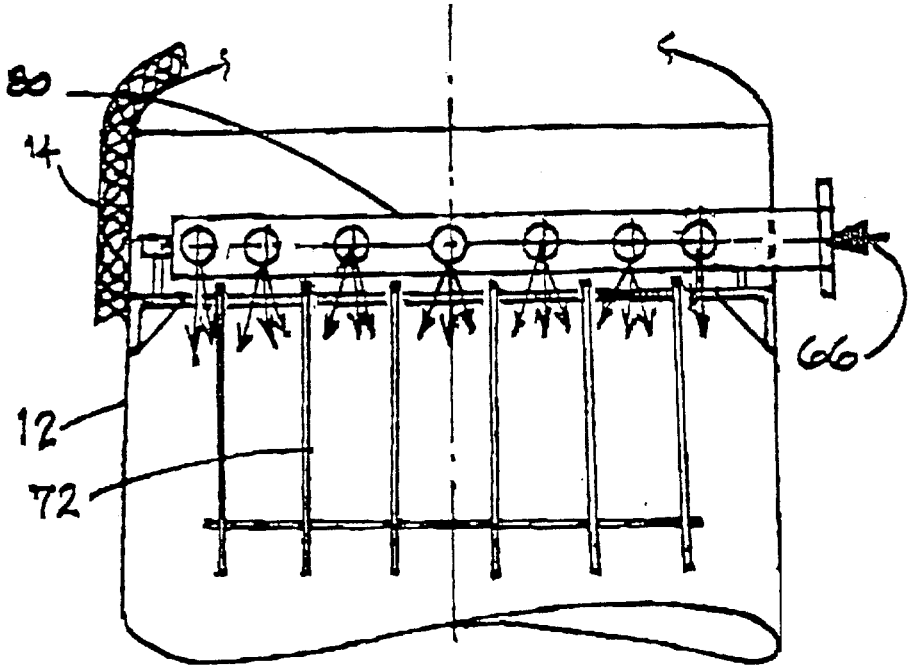
FIG. 5 is a side elevation of the wetted plate separator arrangement.

Referring now to FIG. 1 of the drawing there is shown a system for diluent recovery from oil sand extraction tailings. Apparatus 10 comprises a containment vessel 12 having a top 14, a bottom 16, and peripheral side walls 18. Referring to FIG. 3 each nozzle 20 and 22 has a first inlet 24 for receiving a first fluid, a second inlet 26 for receiving a second fluid and a single outlet 28 for discharging a confluent stream of the first fluid and the second fluid. As seen in FIG. 1 nozzles 20 and 22 are oriented in 180 degree opposed relation such that their discharge streams are directed to impact with each other. An eductor 30 is used as means for drawing vapors from containment vessel 12. Eductor 30 is positioned at the top of vessel 12. Vapors pass through a wetted plate separator and a demister pad 31 to eductor 30. An outlet 32 is positioned adjacent bottom 16 of vessel 12 for removing the stripped oil sand tailings. Saturated steam passes through flow line 38 where it is diverted by a series of secondary flow lines. Secondary flow line 40 controlled by valve 42 brings saturated steam to eductor 30. Secondary flow lines 44 and 46 controlled by valves 48 and 50 bring saturated steam to nozzles 20 and 22. Secondary flow line 52 controlled by valve 54 brings saturated steam to steam sparger 56 positioned within and in spaced relation from the bottom 16 of vessel 12. Outlet 32 is connected to a pump-out line 74 having a branch line controlled by valve 76. The drain valve 76, the use of which, is to effect cleaning of the containment vessel is also used to obtain samples of the cleaned tailings. Referring to FIG. 3, the preferred form of nozzles 20 and 22 includes a body having a first inlet 24 and a second inlet 26 in addition to a common outlet 28. First inlet 24 of nozzle 22 communicates with oil sand tailings line 36 and second inlet 26 communicates with steam flow line 46. Nozzle 20 is similarly connected. Referring to FIG. 5, the rising vapors and small droplets generated by the impact when the jet streams meet, are drawn through plates 72 of a plate separator. It is inevitable that some fine mineral particles will be entrained in the upflow and will stick to the plate surfaces. A continuous fine hot water spray will be provided to wash the plates clean and prevent the growth of particles on the plates.

Figure 2:
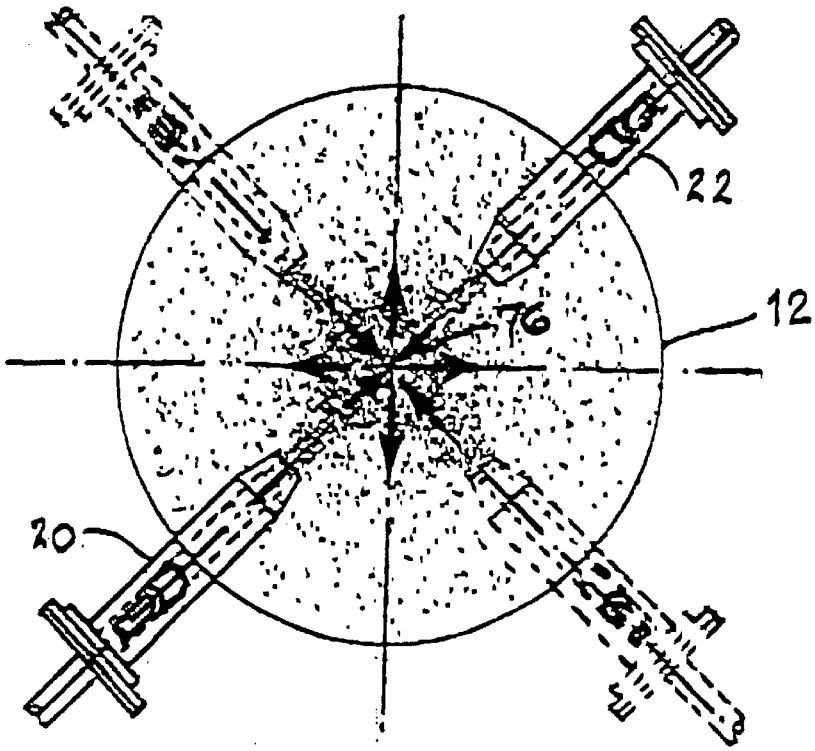
FIG. 2 is a plan view of the nozzle orientation when installed in the apparatus for solvent recovery from oil sand tailings. In this view, two additional nozzles have been shown in dotted lines to indicate the possibility of using a plurality of opposed nozzles. For purposes of explanation only one set of nozzles will be considered.

The use and operation of apparatus 10, as illustrated in FIGS. 1 through 5, will now be described in relation to the preferred method of operation for which such apparatus was developed. Two nozzles 20 and 22 are positioned in 180 degrees opposed relation in a common horizontal plane such that the jet stream from one nozzle forms an impaction target for the jet stream from the opposed nozzle. Additional paired nozzles can be added if desired, as shown by way of example, in dotted lines in FIG. 2. With the nozzles so positioned oil sand tailings are directed through flow lines 36 to the first inlet 24 of nozzles 20 and 22. Saturated steam is then injected via steam flow lines 44 and, as seen in FIG. 1, into the second inlets 26 of nozzles 20 and 22 to produce at the outlet of the nozzles a confluent stream of steam and oil sand tailings. Referring to FIGS. 2 and 3 saturated steam flowing through secondary inlet 26 is passed through coiled tubing 29 to impart to the steam a spiral component of velocity before it mixes with oil sand tailings pumped through first inlets 24. Oil sand tailings pass from first inlet 24 into an extension of the nozzle just inside the nozzle outlet 28. Outlet 28 is so shaped that the high velocity spiraling steam flow meets with the oil sand tailings just inboard of nozzle outlet 28. When a mixed stream of steam and oil sand tailings is created, as described, an expansion of the steam causes an acceleration of each of the mixed streams resulting in a violent collision of the streams. By having the steam and tailing flows meet just short off the outlet 28 the steam pushes the stream of oil sand tailings further enhancing the impact velocity. With this method of operation impact velocities approaching 7000 feet per minute can be attained.

The method of operation as it applies to solvent recovery from oil sand tailings will now be summarized. High velocity oil sand tailings streams are emitted from diametrically opposed nozzles 20 and 22. The streams are accelerated through the use of steam injections. The mixed streams impact each other to produce a violent collision in which solvent is ejected in the form of solvent vapors. The vapors are removed from the top 14 of containment vessel 12 by a vacuum generated by eductor 30. The solvent vapors will be evacuated from inside containment vessel 12 along with low pressure steam. To achieve the high velocities required saturated steam at approximately 150 pounds per square inch is allowed to expand when entering nozzles 20 and 22. As previously noted, steam velocities can reach speeds as high as 7000 feet per minute, depending on the back pressure inside containment vessel 12. When the mixed streams collide kinetic energy will be converted to potential energy, or pressure energy. The pressure change will be rapid squeezing out the solvent vapors in a solution state from inside the host structure. A very large spray of small droplets is generated surrounding the impact area. The solvent vapors remaining inside the droplets are presented with a second opportunity to escape through the surface area of the droplets since the pressure of containment vessel 12 is kept low by eductor 30 thus assisting in escape of the solvent vapors out of the droplets.

Figure 4:
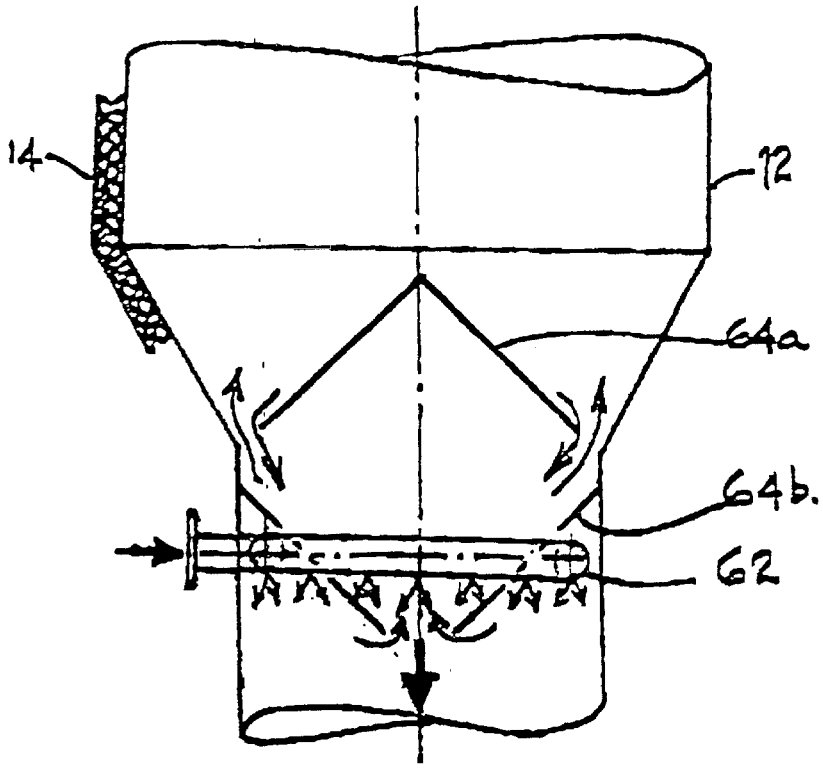
FIG. 4 is a side elevation view showing the shed deck and doughnut deck arrangements for final heating of the oil sands tailings.

There is one more area where solvent vapors can be removed from the tailings host. As seen in FIG. 4 the droplets generated in the impact zone will drop down and gather as a thin layer on top of shed-deck 64*a* from which area they flow onto a doughnut deck 64*b* located below the shed-deck. The underside of these decks are kept hot by a sparging steam delivered by sparger ring 62. From this point the oil sand tailings continue on their way down to the collecting sump 84 as seen in FIG. 1. Solvent vapors that escape will rise to the top of the containment vessel 12 where they are evacuated through the demister pad 31 and ejector 30.

In sump 84 where the treated oil sands tailings eventually come to rest there is a final steam sparger 56. The main function of the sparger is to ensure that the tailings keep sufficiently warm so that the slurry remains fluid enough to pump out through nozzle 32 located at the bottom 16 of the containment vessel. The result is that steam sparger 56 not only keeps the tailings host hot but also additionally assists in the removal of trace amounts of the solvent. The expansion of the steam will cause the temperature of the host tailings to drop. The main function of the steam sparger 56 is to keep the oil sands tailings from becoming too viscous when the temperature drops to permit their removal by pump. There is also a potential danger that small quantities of bitumen from the upstream process could accumulate in the sump 84 and make evacuation by pump impossible if the temperature drops below 60 degrees centigrade. The oil sand tailing minus the solvent is withdrawn through outlet 32 at a fixed rate and under control of a pump to a storage unit not shown.

As a last point in the solvent recovery process the solvent vapors that accumulate at the top 14 of the vessel are removed through a plate separator 72. The plates are kept wet with hot water by sparger 80 located above the plates. The solvent vapors will escape through the plate spaces and through the demister 31 to be evacuated by eductor 30 and delivered to an overhead condenser, (not shown), where the solvent is recovered and returned to the process.

It will be apparent to one skilled in the art that modifications may be made to the illustrated embodiment without departing from the scope of the invention as hereinafter defined in the appended claims.

I claim:

1. A method of recovering solvent from oil sand tailings which comprises:

providing at least one acceleration nozzle having first and second inlets having a common outlet positioned within a container maintained at less than atmospheric pressure;

passing solvent-contaminated oil sand tailings through the first inlet and passing saturated steam through the second outlet;

discharging the saturated steam and oil sand tailings from the acceleration nozzle in a confluent stream converging at a common point and colliding against an impact target located outside the acceleration nozzle and within the contaner;

and removing from the container solvent stripped from the host tailings as a result of the impact by means of vacuum.

* * * * *